US008538747B2

(12) United States Patent
Jasiuk et al.

(10) Patent No.: US 8,538,747 B2
(45) **Date of Patent: *Sep. 17, 2013**

(54) METHOD AND APPARATUS FOR SPEECH CODING

(75) Inventors: Mark A. Jasiuk, Chicago, IL (US); Tenkasi V. Ramabadran, Naperville, IL (US); Udar Mittal, Hoffman Estates, IL (US); James P. Ashley, Naperville, IL (US); Michael J. McLaughlin, Palatine, IL (US)

(73) Assignee: Motorola Mobility LLC, Libertyville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/838,913

(22) Filed: Jul. 19, 2010

(65) Prior Publication Data

US 2010/0286980 A1 Nov. 11, 2010

Related U.S. Application Data

(62) Division of application No. 10/964,861, filed on Oct. 14, 2004, now Pat. No. 7,792,670.

(60) Provisional application No. 60/531,396, filed on Dec. 19, 2003.

(51) Int. Cl.
*G10L 21/02* (2013.01)

(52) U.S. Cl.
USPC ..... 704/226; 704/500; 704/501; 704/502; 704/503; 704/504

(58) Field of Classification Search
None
See application file for complete search history.

(56) References Cited

U.S. PATENT DOCUMENTS

| | | | |
|---|---|---|---|
| 5,327,520 | A | 7/1994 | Chen |
| 5,359,696 | A | 10/1994 | Gerson et al. |
| 5,396,576 | A | 3/1995 | Miki et al. |
| 5,845,244 | A | 12/1998 | Proust |
| 5,884,251 | A | 3/1999 | Kim et al. |
| 5,974,377 | A | 10/1999 | Navarro et al. |

(Continued)

FOREIGN PATENT DOCUMENTS

WO WO01-91112 A1 11/2001

OTHER PUBLICATIONS

Atal, et al., "On Improving the Performance of Pitch Predictors in Speech Coding Systems," Advances in Speech Coding, Kluwer Academic Publishers, Boston/Dordecht/London, 1991, Section Vii, Chapter 30, pp. 321-327.

(Continued)

*Primary Examiner* — Leonard Saint Cyr

(57) ABSTRACT

A method and apparatus for prediction in a speech-coding system extends a 1st order long-term predictor (LTP) filter, using a sub-sample resolution delay, to a multi-tap LTP filter. From another perspective, a conventional integer-sample resolution multi-tap LTP filter is extended to use sub-sample resolution delay. Such a multi-tap LTP filter offers a number of advantages over the prior-art. Particularly, defining the lag with sub-sample resolution makes it possible to explicitly model the delay values that have a fractional component, within the limits of resolution of the over-sampling factor used by the interpolation filter. The coefficients ($\beta_i$'s) of the multi-tap LTP filter are thus largely freed from modeling the effect of delays that have a fractional component. Consequently their main function is to maximize the prediction gain of the LTP filter via modeling the degree of periodicity that is present and by imposing spectral shaping.

8 Claims, 9 Drawing Sheets

(56) References Cited

U.S. PATENT DOCUMENTS

| | | | |
|---|---|---|---|
| 6,449,590 | B1 | 9/2002 | Gao |
| 6,539,357 | B1 | 3/2003 | Sinha |
| 6,581,031 | B1 | 6/2003 | Ito et al. |
| 2002/0059062 | A1 | 5/2002 | Patel et al. |
| 2003/0177004 | A1 | 9/2003 | Jabri et al. |
| 2003/0200092 | A1 | 10/2003 | Gao |

OTHER PUBLICATIONS

Atal, et al., "Predictive Coding of Speech at Low Bit Rates," IEEE Transactions on Communications, vol. Com-30, No. 4, Apr. 1982, pp. 600-607.

Qian, et al., "Pseudo-Multi-Tap Pitch Filters in a Low Bit-Rate CELP Speech Coder," Elsevier Science B.V., Jun. 9, 1994, pp. 1-20.

Ramachandran, et al., "Pitch Prediction Filters in Speech Coding," IEEE Transactions on Acoustics, Speech and Signal Processing, vol. 37, No. 4, Apr. 1989, pp. 467-478.

Stachurski, et al., "A Pitch Pulse Evolution Model for a Dual Excitation Linear Predictive Speech Coder," Proceedings of the Biennial Symposium Communication, May 1994, pp. 107-110.

Yasheng, Q. Etal.: "Pseudo-three-tap pitch prediction filters", Plenary, Special, Audio, Underwater Acoustics, VLSI, Neural Networks, Minneapolis, Apr. 27-30, 1993; {Proceedings of the International Conference on Acoustics, Speech, and Signal Processing (ICASSP)}, New York, IEEE, US, vol. 2, Apr. 27, 1993, pp. 523-526.

Chinese Examiner, "Notification of 1st Office Action," The State Intellectual Property Office of the People's Republic of China, Beijing, China, Mar. 13, 2009, 8 pages, most relevant pp. 1-4.

Chinese Examiner, "Notification of 2nd Office Action," The State Intellectual Property Office of the People's Republic of China, Beijing, China, Oct. 30, 2009, 8 pages, most relevant pp. 1-4.

Chinese Examiner, "Notification of 3rd Office Action," The State Intellectual Property Office of the People's Republic of China, Beijing, China, Feb. 12, 2010, 6 pages, most relevant pp. 1-3.

Chinese Examiner, "Notification on the Grant of Patent Right for Invention," The State Intellectual Property Office of the People's Republic of China, Beijing, China, Jun. 9, 2010, 4 pages, most relevant pp. 1-2.

De Meuleneire, "Supplementary European Search Report," European Patent Office, Rijswijk, Netherlands, Jun. 8, 2009, 3 pages.

N. Sinha, "India—First Examination Report," Government of India, The Patent Office, Salt Lake City, Kolkata, India, Apr. 3, 2007, 3 pages.

N. Sinha, "India—Further Examination Report," Government of India, The Patent Office, Salt Lake City, Kolkata, India, Nov. 23, 2007, 1 page.

N. Sinha, "India—Intimation of Grant of Patent," Government of India, The Patent Office, Salt Lake City, Kolkata, India, Sep. 3, 2009, 1 page.

Japanese Examiner, "1st Office Action," Japanese Patent Office, Tokyo, Japan, Dec. 16, 2008, 3 pages.

Japanese Examiner, "2nd Office Action," Japanese Patent Office, Tokyo, Japan, Feb. 16, 2010, 3 pages.

Japanese Examiner, "Notice of Allowance," Japanese Patent Office, Tokyo, Japan, Jun. 2, 2010, 2 pages.

Jang, et al., "Korea—Notice of Preliminary Rejection," Korean Intellectual Property Office, Daejeon, Republic of Korea, Sep. 28, 2006, 3 pages.

Jang, et al., "Korea—Notice of Patent Grant," Korean Intellectual Property Office, Daejeon, Republic of Korea, May 22, 2007, 3 pages.

-PRIOR ART-

-PRIOR ART-

-PRIOR ART-

-PRIOR ART-

METHOD AND APPARATUS FOR SPEECH CODING

CROSS-REFERENCE(S) TO RELATED APPLICATION(S)

The present application is a divisional application of, and claims priority from, provisional application Ser. No. 60/531,396, entitled "METHOD AND APPARATUS FOR SPEECH CODING," and filed Dec. 19, 2003, and application Ser. No. 10/964,861, entitled "METHOD AND APPARATUS FOR SPEECH CODING," and filed Oct. 14, 2004, which applications are commonly owned and incorporated herein by reference in their entirety.

FIELD OF THE INVENTION

The present invention relates, in general, to signal compression systems and, more particularly, to a method and apparatus for speech coding.

BACKGROUND OF THE INVENTION

Low rate coding applications, such as digital speech, typically employ techniques, such as a Linear Predictive Coding (LPC), to model the spectra of short-term speech signals. Coding systems employing an LPC technique provide prediction residual signals for corrections to characteristics of a short-term model. One such coding system is a speech coding system known as Code Excited Linear Prediction (CELP) that produces high quality synthesized speech at low bit rates, that is, at bit rates of 4.8 to 9.6 kilobits-per-second (kbps). This class of speech coding, also known as vector-excited linear prediction or stochastic coding, is used in numerous speech communications and speech synthesis applications. CELP is also particularly applicable to digital speech encryption and digital radiotelephone communication systems wherein speech quality, data rate, size, and cost are significant issues.

A CELP speech coder that implements an LPC coding technique typically employs long-term (pitch) and short-term (formant) predictors that model the characteristics of an input speech signal and that are incorporated in a set of time-varying linear filters. An excitation signal, or codevector, for the filters is chosen from a codebook of stored codevectors. For each frame of speech, the speech coder applies the codevector to the filters to generate a reconstructed speech signal, and compares the original input speech signal to the reconstructed signal to create an error signal. The error signal is then weighted by passing the error signal through a perceptual weighting filter having a response based on human auditory perception. An optimum excitation signal is then determined by selecting one or more codevectors that produce a weighted error signal with a minimum energy (error value) for the current frame. Typically the frame is partitioned into two or more contiguous subframes. The short-term predictor parameters are usually determined once per frame and are updated at each subframe by interpolating between the short-term predictor parameters for the current frame and the previous frame. The excitation signal parameters are typically determined for each subframe.

For example, FIG. 1 is a block diagram of a CELP coder 100 of the prior art. In CELP coder 100, an input signal s(n) is applied to a linear predictive (LP) analyzer 101, where linear predictive coding is used to estimate a short-term spectral envelope. The resulting spectral coefficients (or linear prediction (LP) coefficients) are denoted by the transfer function A(z). The spectral coefficients are applied to an LP quantizer

102 that quantizes the spectral coefficients to produce quantized spectral coefficients $A_q$ that are suitable for use in a multiplexer 109. The quantized spectral coefficients $A_q$ are then conveyed to multiplexer 109, and the multiplexer produces a coded bitstream based on the quantized spectral coefficients and a set of excitation vector-related parameters L, $\beta_i$'s, I, and $\gamma$, that are determined by a squared error minimization/parameter quantization block 108. As a result, for each block of speech, a corresponding set of excitation vector-related parameters is produced, which includes multi-tap long-term predictor (LTP) parameters (lag L and multi-tap predictor coefficients $\beta_i$'s), and fixed codebook parameters (index I and scale factor $\gamma$).

The quantized spectral parameters are also conveyed locally to an LP synthesis filter 105 that has a corresponding transfer function $\mathbf{1}/A_q(z)$. LP synthesis filter 105 also receives a combined excitation signal ex(n) and produces an estimate of the input signal $\hat{s}(n)$ based on the quantized spectral coefficients $A_q$ and the combined excitation signal ex(n). Combined excitation signal ex(n) is produced as follows. A fixed codebook (FCB) codevector, or excitation vector, $\tilde{c}_1$ is selected from a fixed codebook (FCB) 103 based on a fixed codebook index parameter I. The FCB codevector $\tilde{c}_1$ is then scaled based on the gain parameter $\gamma$ and the scaled fixed codebook codevector is conveyed to a multi-tap long-term predictor (LTP) filter 104. Multi-tap LTP filter 104 has a corresponding transfer function $$\frac{1}{\left(1-\sum_{i=-K_1}^{K_2}\beta_i z^{-L+i}\right)},\quad K_1\geq 0,\quad K_2\geq 0,\qquad (1)$$

$$K=1+K_1+K_2$$

wherein K is the LTP filter order (typically between 1 and 3, inclusive) and $\beta_i$'s and L are excitation vector-related parameters that are conveyed to the filter by squared error minimization/parameter quantization block 108. In the above definition of the LTP filter transfer function, L is an integer value specifying the delay in number of samples. This form of LTP filter transfer function is described in a paper by Bishnu S. Atal, "Predictive Coding of Speech at Low Bit Rates," IEEE Transactions on Communications, VOL. COM-30, NO. 4, April 1982, pp. 600-614 (hereafter referred to as Atal) and in a paper by Ravi P. Ramachandran and Peter Kabal, "Pitch Prediction Filters in Speech Coding," IEEE Transactions on Acoustics, Speech, and Signal Processing, VOL. 37, NO. 4, April 1989, pp. 467-478 (hereafter referred to as Ramachandran et. al.). Filter 104 filters the scaled fixed codebook codevector received from FCB 103 to produce the combined excitation signal ex(n) and conveys the excitation signal to LP synthesis filter 105.

LP synthesis filter 105 conveys the input signal estimate $\hat{s}(n)$ to a combiner 106. Combiner 106 also receives input signal s(n) and subtracts the estimate of the input signal $\hat{s}(n)$ from the input signal s(n). The difference between input signal s(n) and input signal estimate $\hat{s}(n)$ is applied to a perceptual error weighting filter 107, which filter produces a perceptually weighted error signal e(n) based on the difference between $\hat{s}(n)$ and s(n) and a weighting function W(z). Perceptually weighted error signal e(n) is then conveyed to squared error minimization/parameter quantization block 108. Squared error minimization/parameter quantization block 108 uses the error signal e(n) to determine an error value E (typically $$E = \sum_n e^2(n)\Big),$$

and subsequently, an optimal set of excitation vector-related parameters L, $\beta_i$'s, I, and $\gamma$ that produce the best estimate $\hat{s}(n)$ of the input signal s(n) based on the minimization of E. The quantized LP coefficients and the optimal set of parameters L, $\beta_i$'s, I, and $\gamma$ are then conveyed over a communication channel to a receiving communication device, where a speech synthesizer uses the LP coefficients and excitation vector-related parameters to reconstruct the estimate of the input speech signal $\hat{s}(n)$. An alternate use may involve efficient storage to an electronic or electromechanical device, such as a computer hard disk.

In a CELP coder such as coder 100, a synthesis function for generating the CELP coder combined excitation signal ex(n) is given by the following generalized difference equation:

$$ex(n) = \gamma \tilde{c}_I(n) \sum_{i=-K_1}^{K_2} \beta_i ex(n-L+i), \quad n = 0, \ldots, N-1, \quad K_1 \geq 0, \quad K_2 \geq 0 \tag{1a}$$

where ex(n) is a synthetic combined excitation signal for a subframe, $\tilde{c}_1(n)$ is a codevector, or excitation vector, selected from a codebook, such as FCB 103, I is an index parameter, or codeword, specifying the selected codevector, $\gamma$ is the gain for scaling the codevector, ex(n−L+i) is a synthetic combined excitation signal delayed by L (integer resolution) samples relative to the (n+i)-th sample of the current subframe (for voiced speech L is typically related to the pitch period), $\beta_i$'s are the long term predictor (LTP) filter coefficients, and N is the number of samples in the subframe. When n−L+i<0, ex(n−L+i) contains the history of past synthetic excitation, constructed as shown in eqn. (1a). That is, for n−L+i<0, the expression 'ex(n−L+i)' corresponds to an excitation sample constructed prior to the current subframe, which excitation sample has been delayed and scaled pursuant to an LTP filter transfer function $$\frac{1}{1 - \sum_{i=-K_1}^{K_2} \beta_i z^{-L+i}}, \quad K_1 \geq 0, \quad K_2 \geq 0, \quad K = 1 + K_1 + K_2 \tag{2}$$

The task of a typical CELP speech coder such as coder 100 is to select the parameters specifying the synthetic excitation, that is, the parameters L, $\beta_i$'s, I, $\gamma$ in coder 100, given ex(n) for n<0 and the determined coefficients of short-term Linear Predictor (LP) filter 105, so that when the synthetic excitation sequence ex(n) for 0≦n<N is filtered through LP filter 105, the resulting synthesized speech signal $\hat{s}(n)$ most closely approximates, according to a distortion criterion employed, the input speech signal s(n) to be coded for that subframe.

When the LTP filter order K>1, the LTP filter as defined in eqn. (1) is a multi-tap filter. A conventional integer-sample resolution delay multi-tap LTP filter, as described, seeks to predict a given sample as a weighted sum of K, usually adjacent, delayed samples, where the delay is confined to a range of expected pitch period values (typically between 20 and 147 samples at 8 kHz signal sampling rate). An integer-sample resolution delay (L) multi-tap LTP filter has the ability to implicitly model non-integer values of delay while simultaneously providing spectral shaping (Atal, Ramachandran et. al.). A multi-tap LTP filter requires quantization of the K unique $\beta_i$ coefficients, in addition to L. If K=1, a 1st order LTP filter results, requiring quantization of only a single $\beta_0$ coefficient and L. However, a 1st order LTP filter, using integer-sample resolution delay L, does not have the ability to implicitly model non-integer delay value, other than rounding it to the nearest integer or an integer multiple of a non-integral delay. Neither does it provide spectral shaping. Nevertheless, 1st order LTP filter implementations have been commonly used, because only two parameters—L and $\beta$ need to be quantized, a consideration for many low-bit rate speech coder implementations.

The introduction of the 1st order LTP filter, using a sub-sample resolution delay, significantly advanced the state-of-the-art of LTP filter design. This technique is described in U.S. Pat. No. 5,359,696, "Digital Speech Coder Having Improved Sub-sample Resolution Long-Term Predictor," by Ira A. Gerson and Mark A. Jasiuk (thereafter referred to as Gerson et. al.) and also in a textbook chapter by Peter Kroon and Bishnu S. Atal, "On Improving the Performance of Pitch Predictors in Speech Coding Systems," Advances in Speech Coding, Kluwer Academic Publishers, 1991, Chapter 30, pp. 321-327 (thereafter referred to as Kroon et. al). Using this technique, the value of delay is explicitly represented with sub-sample resolution, redefined here as $\hat{L}$. Samples delayed by $\hat{L}$ may be obtained by using an interpolation filter. To compute samples delayed by values of $\hat{L}$ having different fractional parts, the interpolation filter phase that provides the closest representation of the desired fractional part may be selected to generate the sub-sample resolution delayed sample by filtering using the interpolation filter coefficients corresponding to the selected phase of the interpolation filter. Such a 1st order LTP filter, which explicitly uses a sub-sample resolution delay, is able to provide predicted samples with sub-sample resolution, but lacks the ability to provide spectral shaping. Nevertheless, it has been shown (Kroon et. al.) that a 1st order LTP filter, with a sub-sample resolution delay, can more efficiently remove the long-term signal correlation than a conventional integer-sample resolution delay multi-tap LTP filter. Being a 1st order LTP filter, only two parameters need to be conveyed from the encoder to the decoder $\beta$ and $\hat{L}$, resulting in improved quantization efficiency relative to integer-resolution delay multi-tap LTP filter, which requires quantization of L, and K unique $\beta_i$ coefficients. Consequently, the 1st order sub-sample resolution form of the LTP filter is the most widely used in current CELP-type speech coding algorithms. The LTP filter transfer function for this filter is given by $$\frac{1}{1 - \beta z^{-\hat{L}}} \tag{3}$$

with the corresponding difference equation given by:

Implicit in equations (3) and (4) is the use of an interpolation filter to compute samples pointed to by the sub-sample resolution delay $\hat{L}$.

FIG. 2 shows the inherent differences between the multi-tap LTP (shown in FIG. 1), and the LTP with sub-sample resolution, as described above. In coder 200, LTP 204 requires only two parameters ($\beta$, $\hat{L}$) from the error minimization/parameter quantization block 208, which subsequently conveys parameters $\hat{L}$, $\beta$, I, $\gamma$ to multiplexer 109.

Note that in describing the LTP filter, a generalized form of the LTP filter transfer function has been given. ex(n) for values of n<0 contains the LTP filter state. For values of L or $\hat{L}$ which necessitate access to samples of n, for n≦0, when evaluating ex(n) in eqn. (1) or (4), a simplified and non-equivalent form for the LTP filter is often used—called a virtual codebook or an adaptive codebook (ACB), which will be later described in more detail. This technique is described in U.S. Pat. No. 4,910,781 by Richard H. Ketchum, Willem B. Kleijn, and Daniel J. Krasinski, titled "Code Excited Linear Predictive Vocoder Using Virtual Searching," (hereafter referred to as Ketchum et. al.). The term "LTP filter," strictly speaking, refers to a direct implementation of eqn. (1a) or (4), but as used in this application it may also refer to an ACB implementation of the LTP filter. In the instances when this distinction is important to the description of the prior art and the current invention, it will explicitly be made.

The graphical representation of an ACB implementation can be seen in FIG. 3. When the value of the sub-sample resolution filter delay $\hat{L}$ is greater than the subframe length N, FIGS. 2 and 3 are generally equivalent. In this case, the ACB memory 310 and LTP filter 204 memory contain essentially the same data. When the filter delay is less than the length of a subframe, however, the scaled FCB excitation and LTP filter memory are re-circulated through the LTP memory 204 and are subject to recursive scaling iterations by the $\beta$ coefficient. In the ACB implementation 310, the ACB vector is circulated using a unity gain long-term filter of the form:

$$ex(n)=ex(n-\hat{L}),0\leqq n<N \tag{4a}$$

and then letting $c_0(n)=ex(n)$, $0\leqq n<N$, which is subsequently scaled by a single, non-recursive instance of the $\beta$ coefficient.

Considering the two methods of implementing an LTP filter, which were discussed; i.e., an integer-resolution delay multi-tap LTP filter and a $1^{st}$ order sub-sample resolution delay LTP filter, each capable of being implemented directly (100, 200) or via the ACB method (300), the following observations can be made:

The conventional multi-tap predictor performs two tasks simultaneously: spectral shaping and implicit modeling of a non-integer delay through generating a predicted sample as a weighted sum of samples used for the prediction (Atal et. al., and Ramachandran et. al.). In the conventional multi-tap LTP filter, the two tasks—spectral shaping and the implicit modeling of non-integer delay—are not efficiently modeled together. For example, a $3^{rd}$ order multi-tap LTP filter, if no spectral shaping for a given subframe is required, would implicitly model the delay with non-integer resolution. However, the order of such a filter is not sufficiently high to provide a high quality interpolated sample value.

The $1^{st}$ order sub-sample resolution LTP filter, on the other hand, can explicitly use a fractional part of the delay to select a phase of an interpolating filter of arbitrary order and thus very high quality. This method, where the sub-sample resolution delay is explicitly defined and used, provides a very efficient way of representing interpolation filter coefficients. Those coefficients do not need to be explicitly quantized and transmitted, but may instead be inferred from the delay received, where that delay is specified with sub-sample resolution. While such a filter does not have the ability to introduce spectral shaping, for voiced (quasi-periodic) speech it has been found that the effect of defining the delay with sub-sample resolution is more important than the ability to introduce spectral shaping (Kroon et. al.). These are some of the reasons why a $1^{st}$ order LTP filter, with sub-sample resolution delay, can be more efficient than a conventional multi-tap LTP filter, and is widely used in numerous industry standards.

While a sub-sample resolution $1^{st}$ order LTP filter provides a very efficient model for an LTP filter, it may be desirable to provide a mechanism to do spectral shaping, a property which a sub-sample resolution $1^{st}$ order LTP filter lacks. The speech signal harmonic structure tends to weaken at higher frequencies. This effect becomes more pronounced for wideband speech coding systems, characterized by increased signal bandwidth (relative to narrow-band signals). In wideband speech coding systems, a signal bandwidth of up to 8 kHz may be achieved (given 16 kHz. sampling frequency) compared to the 4 kHz maximum achievable bandwidth for narrow-band speech coding systems (given 8 kHz sampling frequency). One method of adding spectral shaping is described in the Patent WO 00/25298 by Bruno Bessette, Redwan Salami, and Roch Lefebvre, titled "Pitch Search in Coding Wideband Signals," (thereafter referred to as Bessette et. al.). This approach, as depicted in FIG. 4, stipulates provision of at least two spectral shaping filters (420) to select from (one of which may have a unity transfer function), and requires that the LTP vector be explicitly filtered by the spectral shaping filter being evaluated. An alternate implementation of this approach is also described, whereby at least two distinct interpolation filters are provided, each having distinct spectral shaping. In either of those two implementations, the filtered version of the LTP vector is then used to generate a distortion metric, which is evaluated (408) to select which of the at least two spectral shaping filters to use (421), in conjunction with the LTP filter parameters. Although this technique does provide the means to vary spectral shaping, it requires that a spectrally shaped version of the LTP vector be explicitly generated prior to the computation of the distortion metric corresponding to that LTP vector and spectral shaping filter combination. If a large set of spectral shaping filters is provided to select from, this may result in appreciable increase in complexity due to the filtering operations. Also, the information related to the selected filter, such as an index m, needs to be quantized and conveyed from the encoder (via multiplexer 109) to the decoder.

Therefore, a need exists for a method and apparatus for speech coding that is capable of efficiently modeling (with low complexity) the non-integral values of delay as well as having an ability to provide spectral shaping.

DETAILED DESCRIPTION OF THE INVENTION

In order to address the above-mentioned need, a method and apparatus for prediction in a speech-coding system is provided herein. The method of a $1^{st}$ order LTP filter, using a sub-sample resolution delay, is extended to a multi-tap LTP filter, or, viewed from another vantage point, the conventional integer-sample resolution multi-tap LTP filter is extended to use sub-sample resolution delay. This novel formulation of a multi-tap LTP filter offers a number of advantages over the prior-art LTP filter configurations. Defining the lag with sub-sample resolution makes it possible to explicitly model the delay values that have a fractional component, within the limits of resolution of the over-sampling factor used by the interpolation filter. The coefficients ($\beta_i$'s) of such a multi-tap LTP filter are thus largely freed from modeling the effect of delays that have a fractional component. Consequently their main function is to maximize the prediction gain of the LTP filter via modeling the degree of periodicity that is present and by imposing spectral shaping. This is in contrast to a conventional integer-sample resolution multi-tap LTP filter, which uses a single, and less efficient, model to tackle the sometimes conflicting tasks of modeling both the non-integer valued delays and spectral shaping. Comparing the new LTP filter to the $1^{st}$ order sub-sample resolution LTP filter, the new method, in extending a $1^{st}$ order sub-sample resolution LTP filter to a multi-tap LTP filter, adds an ability to model spectral shaping.

For some speech coder applications, it may be desirable to spectrally shape the LTP vector. For example, the new formulation of the LTP filter, offering a very efficient model for representing both sub-sample resolution delay and spectral shaping, may be used to improve speech quality at a given bit rate. For speech coders with wideband signal input, the ability to provide spectral shaping takes on additional importance, because the harmonic structure in the signal tends to diminish at higher frequencies, with the degree to which this occurs varying from subframe to subframe. The prior art method of adding spectral shaping to a $1^{st}$ order sub-sample resolution LTP filter (Bessette, et. al.), applies a spectral shaping filter to the output of the LTP filter, with at least two shaping filters being provided to select from. The spectrally shaped LTP vector is then used to generate a distortion metric, and that distortion metric is evaluated to determine which spectral shaping filter to use.

Figure 1:
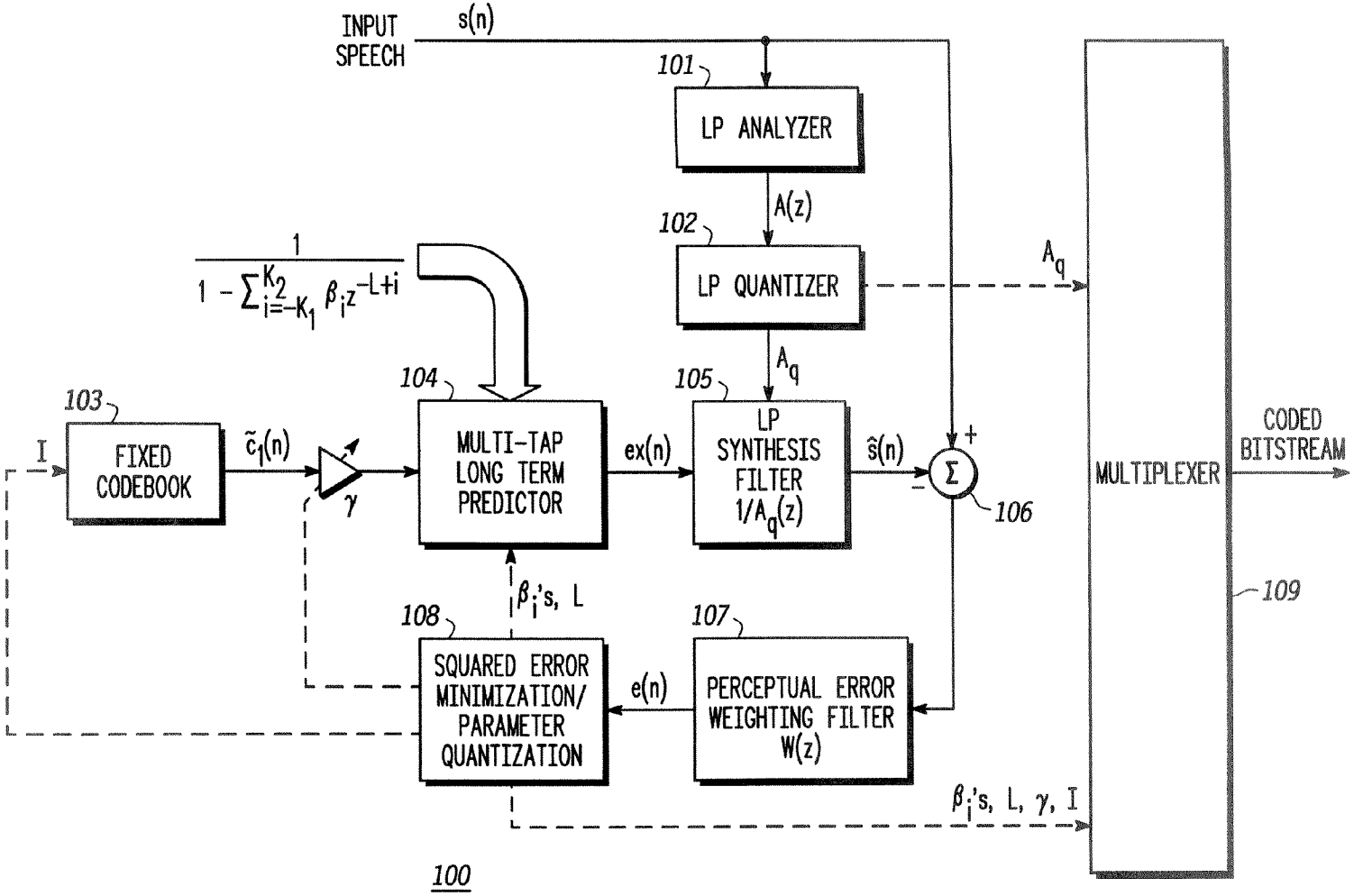
FIG. 1 is a block diagram of a Code Excited Linear Prediction (CELP) coder of the prior art using integer-sample resolution delay multi-tap LTP filter.
Figure 2:
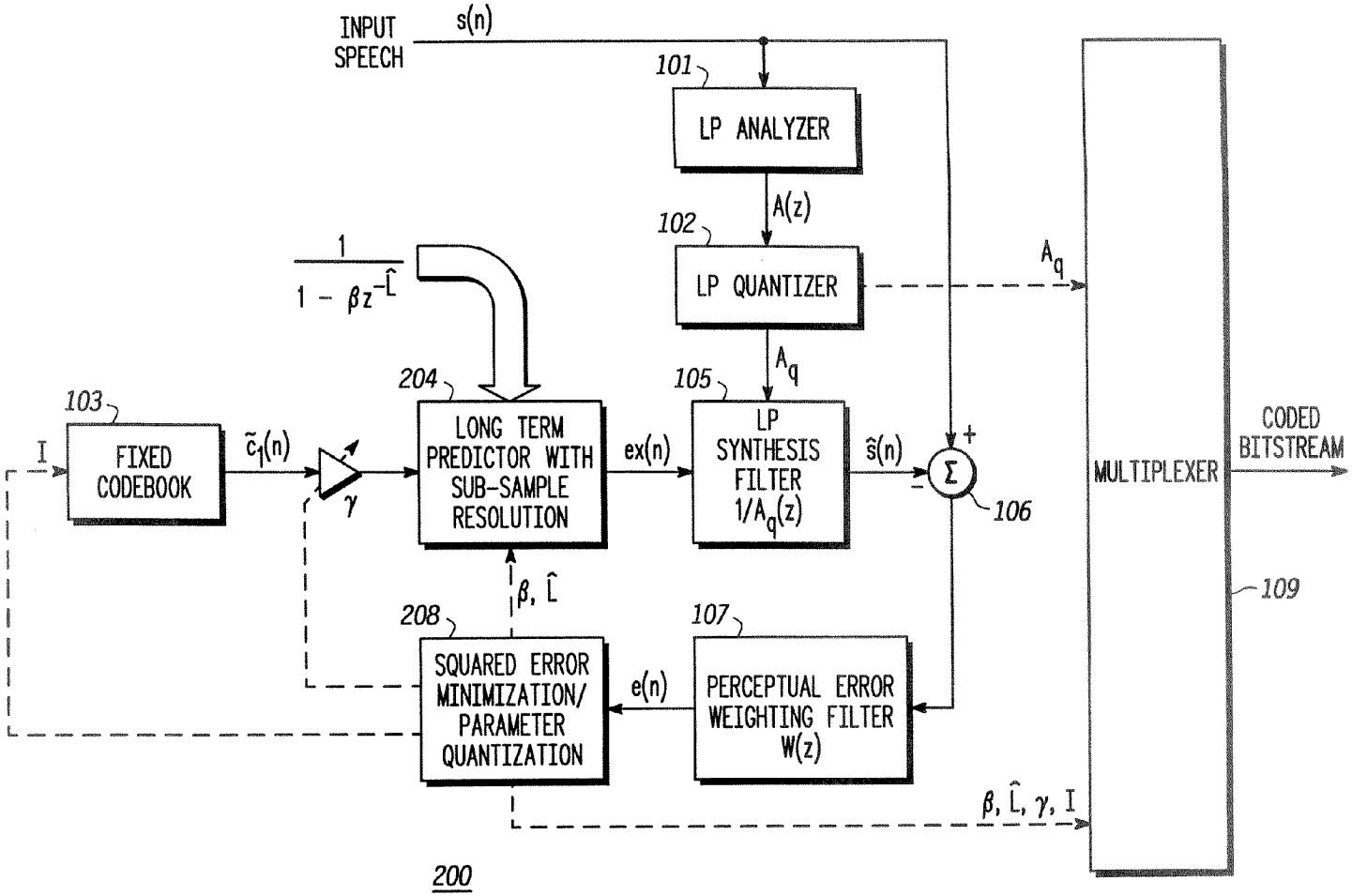
FIG. 2 is a block diagram of a Code Excited Linear Prediction (CELP) coder of the prior art using sub-sample resolution $1^{st}$ order LTP filter.
Figure 3:
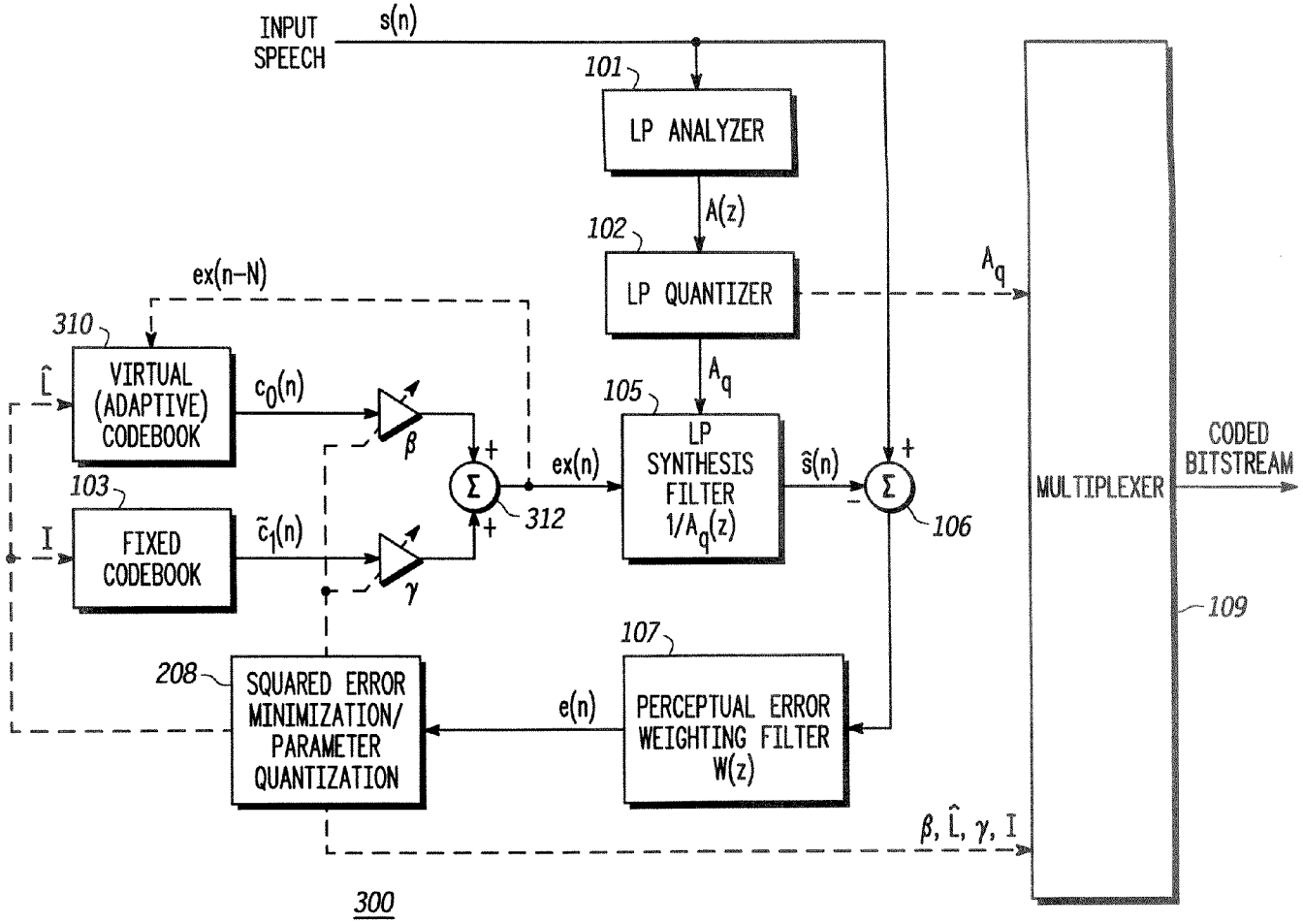
FIG. 3 is a block diagram of a Code Excited Linear Prediction (CELP) coder of the prior art using sub-sample resolution $1^{st}$ order LTP filter (implemented as a virtual codebook).
Figure 4:
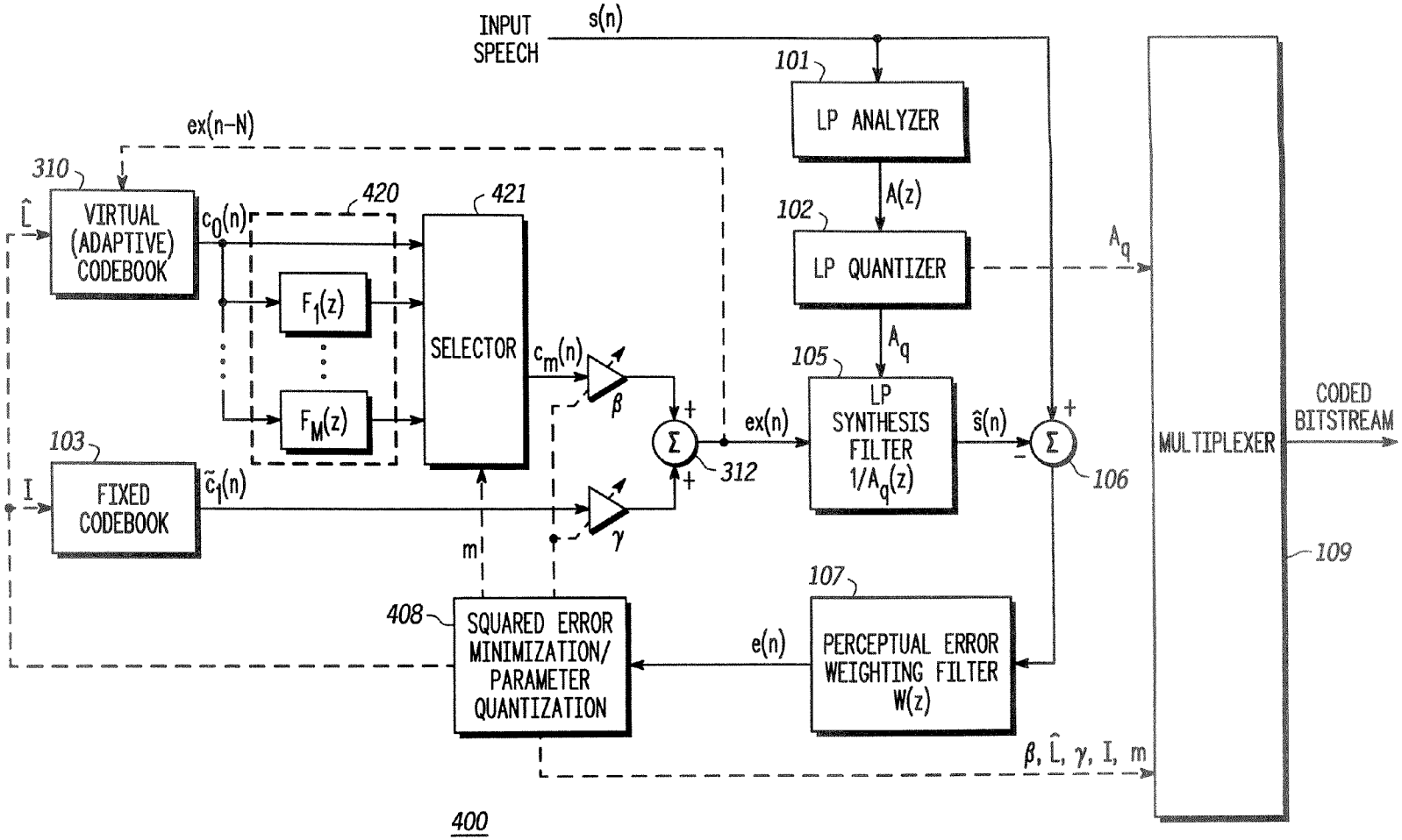
FIG. 4 is a block diagram of a Code Excited Linear Prediction (CELP) coder of the prior art using sub-sample resolution $1^{st}$ order LTP filter (implemented as a virtual codebook) and a spectral shaping filter.
Figure 5:
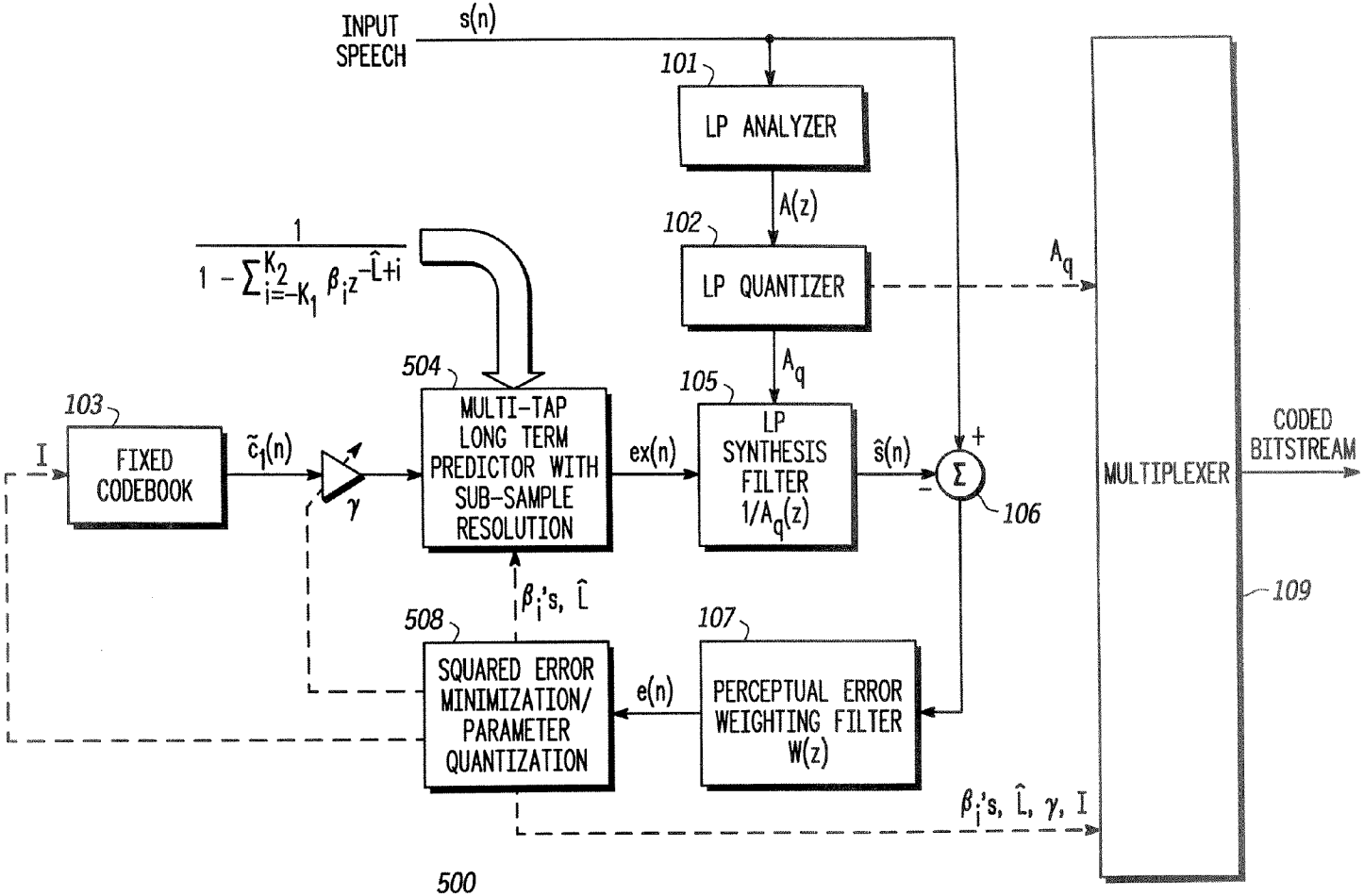
FIG. 5 is a block diagram of a Code Excited Linear Prediction (CELP) coder in accordance with an embodiment of the present invention (unconstrained sub-sample resolution multi-tap LTP filter).

FIG. 5 shows an LTP filter configuration that provides a more flexible model for representing the sub-sample resolution delay and spectral shaping. The filter configuration provides a method for computing or selecting the parameters of such a filter without explicitly performing spectral shape filtering operations. This aspect of the invention makes it feasible to very efficiently compute filter parameters $\beta_i$'s that embody information about an optimal spectral shaping, or to select multi-tap filter coefficients $\beta_i$'s, from a provided set of $\beta_i$ coefficient values (or $\beta_i$ vectors). The generalized transfer function of LTP filter 504 is:

$$\frac{1}{1-\sum_{i=-K_1}^{K_2}\beta_i z^{-\hat{L}+i}},\quad K_1\geq 0,\quad K_2\geq 0,\quad K_1+K_2>0,\qquad (5)$$

$$K=1+K_1+K_2$$

The order of the filter above is K, where selecting K>1, results in a multi-tap LTP filter. The delay $\hat{L}$ is defined with sub-sample resolution and for delay values ($-\hat{L}+i$) having a fractional part, an interpolating filter is used to compute the sub-sample resolution delayed samples as detailed in Gerson et. al. and Kroon et. al. The coefficients ($\beta_i$'s), largely freed from modeling the effect of delays that have a fractional component, may be computed or selected to maximize the prediction gain of the LTP filter by modeling the degree of periodicity that is present and by simultaneously imposing spectral shaping. This is another distinction between the new LTP filter configuration and Bessette et. al. The ($\beta_i$'s) coefficients implicitly embody the spectral shaping characteristic; that is, there need not be a dedicated set of spectral shaping filters to select from, with the filter selection decision then quantized and conveyed from the encoder to the decoder. For example, if vector quantization of the $\beta_i$ coefficients is done and the $\beta_i$ vector quantization table contains J possible $\beta_i$ vectors to select from, such a table may implicitly contain J distinct spectral shaping characteristics, one for each $\beta_i$ vector. Moreover, no spectral shape filtering needs to be done to compute the distortion metric corresponding to a $\beta_i$ vector being evaluated (in 508), as will be explained. In another embodiment of the invention, the LTP filter coefficients may be entirely prevented from attempting to model non-integer delays, by requiring the multiple taps of the LTP filter to be symmetric. A symmetric filter requires that $\beta_{-1}=\beta_i$ for all valid values of index i; that is, for $K_1 \leqq i \leqq K_2$ where $K_1=K_2$ and K is odd. Such a configuration may be advantageous for quantization efficiency and to reduce computational complexity.

Figure 6:
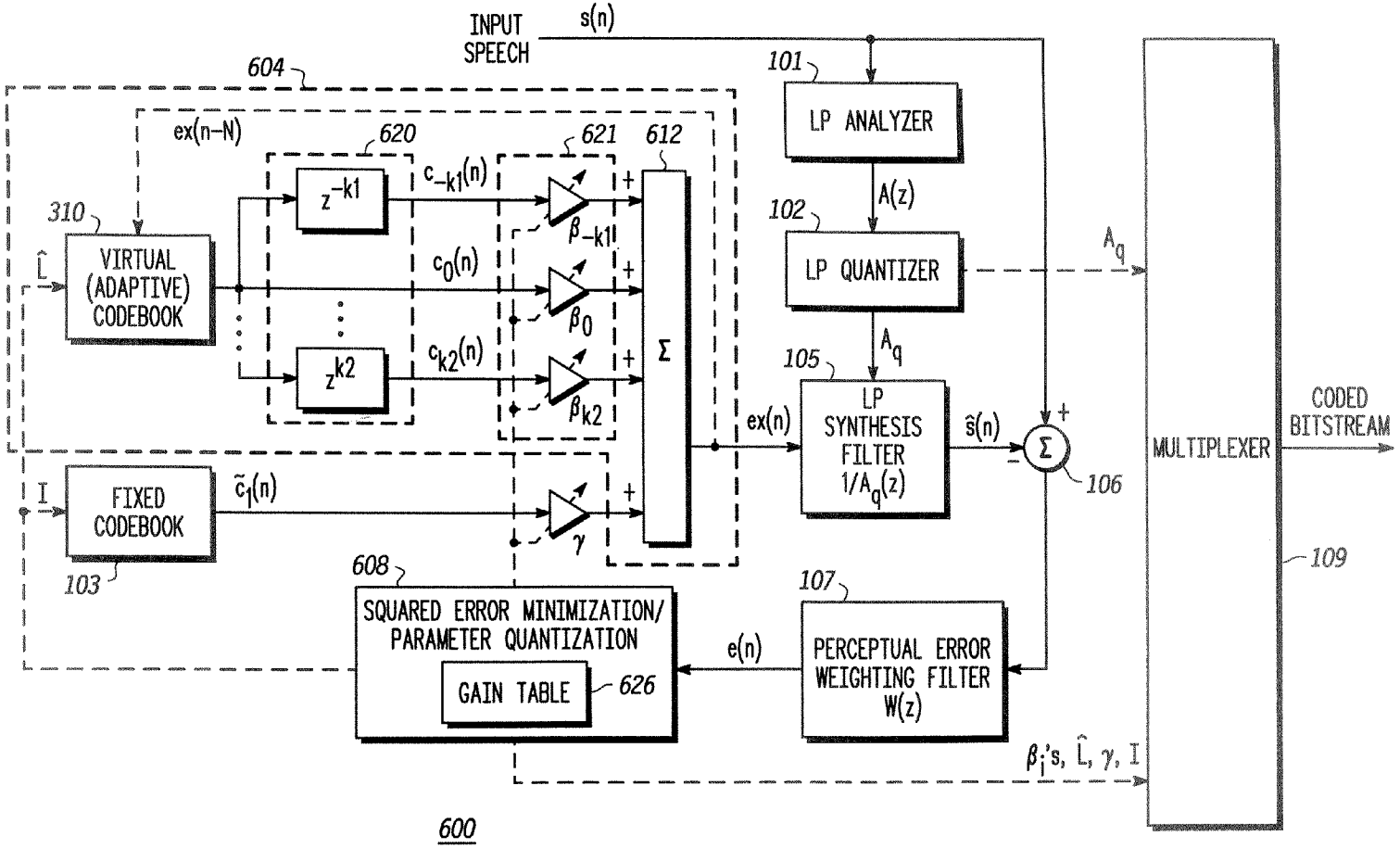
FIG. 6 is a block diagram of a Code Excited Linear Prediction (CELP) coder in accordance with an embodiment of the present invention (unconstrained sub-sample resolution multi-tap LTP filter, implemented as a virtual codebook).

The present invention may be more fully described with reference to FIGS. 6-9. FIG. 6 is a block diagram of a CELP-type speech coder 600 in accordance with an embodiment of the present invention. As is evident, LTP filter 604 comprises a multi-tap LTP filter 604, including codebook 310, K-excitation vector generator (620), scaling units (621), and summer 612.

Coder 600 is implemented in a processor, such as one or more microprocessors, microcontrollers, digital signal processors (DSPs), combinations thereof or such other devices known to those having ordinary skill in the art, that is in communication with one or more associated memory devices, such as random access memory (RAM), dynamic random access memory (DRAM), and/or read only memory (ROM) or equivalents thereof, that store data, codebooks, and programs that may be executed by the processor.

The transfer function for the new multi-tap LTP filter (eqn. 5) is restated below:

$$P(z) = \frac{1}{1 - \sum_{i=-K_1}^{K_2} \beta_i z^{-\hat{L}+i}}, \quad K_1 \geq 0, \quad K_2 \geq 0, \quad K_1 + K_2 > 0, \tag{6}$$

$$K = 1 + K_1 + K_2$$

The corresponding CELP generalized difference equation, for creating the combined synthetic excitation ex(n), is:

$$ex(n) = \gamma \tilde{c}_I(n) + \sum_{i=-K_1}^{K_2} \beta_i ex(n - \hat{L} + i), \tag{7}$$

$$0 \leq n < N, \quad \text{where}$$

$$K_1 \geq 0, \quad K_2 \geq 0, \quad K_1 + K_2 > 0, \quad K = 1 + K_1 + K_2$$

In the preferred embodiment for values of $\hat{L}$ which require access to $ex(n-\hat{L}+i)$ for $(n-\hat{L}+i) \geqq 0$, an Adaptive Codebook (ACB) technique is used to reduce complexity. As discussed earlier, this technique is a simplified and non-equivalent implementation of the LTP filter, and is described in Ketchum et. al. The simplification consists of making samples of ex(n) for the current subframe; i.e., $0 \leqq n < N$, dependent on samples of ex(n), defined for $n<0$, and thus independent of the yet to be defined samples of ex(n) for the current subframe, $0 \leqq n < N$. Using this technique, the ACB vector is defined below:

$$ex(n) = ex(n-\hat{L}), 0 \leqq n < N \tag{8}$$

For values of $\hat{L}$ with a fractional component, an interpolating filter is used to compute the delayed samples. Unlike the original definition of the ACB, given in Ketchum et. al., $K_2$ additional samples of ex(n) need to be computed beyond the $N^{th}$ sample of the subframe:

$$ex(n) = ex(n-\hat{L}), N \leqq n < N + K_2 \tag{9}$$

Using samples of ex(n) generated in eqns. (8-9), a new signal $c_i(n)$ is defined:

$$c_i(n) = ex(n+i), 0 \leqq n < N, -K_1 \leqq i \leqq K_2 \tag{10}$$

The combined synthetic subframe excitation may now be expressed, using the results from eqns. (8-10), as:

$$ex(n) = \gamma \tilde{c}_I(n) + \sum_{i=-K_1}^{K_2} \beta_i c_i(n), \quad 0 \leq n < N, \quad -K_1 \leq i \leq K_2 \tag{11}$$

The task of the speech encoder is to select the LTP filter parameters—$\hat{L}$ and $\beta_i$'s—as well as the excitation codebook index I and codevector gain $\gamma$, so that the perceptually weighted error energy between the input speech s(n) and the coded speech $\hat{s}(n)$ is minimized.

Rewriting eqn. (11) results in $$ex(n) = \sum_{j=0}^{K} \lambda_j \bar{c}_j(n), \; 0 \leq n < N, \text{ where} \tag{12}$$

$$\bar{c}_j(n) = \begin{cases} c_{-K_1+j}(n), & 0 \leq j < K \\ \tilde{c}_I(n), & j = K \end{cases}, \quad 0 \leq n < N \tag{13}$$

-continued $$\lambda_j = \begin{cases} \beta_{-K_1+j}, & 0 \leq j < K \\ \gamma, & j = K \end{cases} \tag{14}$$

Let the ex(n), filtered by the perceptually weighted synthesis filter, be:

$$ex'(n) = \sum_{j=0}^{K} \lambda_j \bar{c}'_j(n), \; 0 \leq n < N \tag{15}$$

$\bar{c}'_j(n)$ is a version of $\bar{c}_j(n)$ filtered by the perceptually weighted synthesis filter $H(z)=W(z)/A_q(z)$. Furthermore, let p(n) be the input speech s(n) filtered by the perceptual weighting filter W(z). Then e(n), the perceptually weighted error per sample, is:

$$e(n) = p(n) - ex'(n) = p(n) - \sum_{j=0}^{K} \lambda_j \bar{c}'_j(n), \; 0 \leq n < N \tag{16}$$

E, the subframe weighted error energy value, is given by:

$$\begin{aligned} E &= \sum_{n=0}^{N-1} e^2(n) \\ &= \sum_{n=0}^{N-1} [p(n) - ex'(n)]^2 \\ &= \sum_{n=0}^{N-1} \left[ p(n) - \sum_{j=0}^{K} \lambda_j \bar{c}'_j(n) \right]^2 \end{aligned} \tag{17}$$

and may be expanded to:

$$E = \sum_{n=0}^{N-1} \left[ p^2(n) - 2\sum_{j=0}^{K} \lambda_j p(n) \bar{c}'_j(n) + 2\sum_{i=0}^{K-1} \sum_{j=i+1}^{K} \lambda_i \lambda_j \bar{c}'_i(n) \bar{c}'_j(n) + \sum_{j=0}^{K} \lambda_j^2 \bar{c}'^2_j(n) \right] \tag{18}$$

Moving the summation $$\sum_{n=0}^{N-1}$$

inside the parenthesis in eqn. (18), results in:

$$E = \sum_{n=0}^{N-1} p^2(n) - 2\sum_{j=0}^{K} \lambda_j \sum_{n=0}^{N-1} p(n) \bar{c}'_j(n) + \tag{19}$$

-continued $$2\sum_{i=0}^{K-1}\sum_{j=i+1}^{K}\lambda_i\lambda_j\sum_{n=0}^{N-1}\bar{c}'_i(n)\bar{c}'_j(n)+\sum_{j=0}^{K}\lambda_j^2\sum_{n=0}^{N-1}\bar{c}'^2_j(n)$$

It is apparent that equation (19) may be equivalently expressed in terms of (i) $\beta_i$, $K_1 \leqq i - K_2$ and $\gamma$, or equivalently in terms of $(\lambda_0, \lambda_1, \ldots, \lambda_K)$, (ii) the cross correlations among the filtered constituent vectors $\bar{c}'_0(n)$ through $\bar{c}'_K(n)$, that is, $(R_{cc}(i,j))$, (iii) the cross correlations between the perceptually weighted target vector p(n) and each of the filtered constituent vectors, that is, $(R_{pc}(i))$, and (iv) the energy in weighted target vector p(n) for the subframe, that is, $(R_{pp})$.

The above listed correlations can be represented by the following equations:

$$R_{pp}=\sum_{n=0}^{N-1}p^2(n) \tag{20}$$

$$R_{pc}(i)=\sum_{n=0}^{N-1}p(n)\bar{c}'_i(n),\quad 0\le i\le K \tag{21}$$

$$R_{cc}(i,j)=\sum_{n=0}^{N-1}\bar{c}'_i(n)\bar{c}'_j(n),\quad 0\le i\le K,\quad i\le j\le K \tag{22}$$

$$R_{cc}(j,i)=R_{cc}(i,j),\quad 0\le i<K,\quad i<j\le K \tag{23}$$

Rewriting equation (19) in terms of the correlations represented by equations (20)-(23) and the gain vector $\lambda_j$, $0 \leqq j \leqq K$ then yields the following equation for E, the perceptually weighted error energy value for the subframe:

$$E=R_{pp}-2\sum_{j=0}^{K}\lambda_jR_{pc}(j)+2\sum_{i=0}^{K-1}\sum_{j=i+1}^{K}\lambda_i\lambda_jR_{cc}(i,j)+\sum_{j=0}^{K}\lambda_j^2R_{cc}(j,j) \tag{24}$$

Solving for a jointly optimal set of excitation vector-related gain terms $\lambda_j$, $0 \leqq j \leqq K$ involves taking a partial derivative of E with respect to each $\lambda_j$, $0 \leqq j \leqq K$, setting each of resulting partial derivative equations equal to zero (0), and then solving the resulting system of K+1 simultaneous linear equations, that is, solving the following set of simultaneous linear equations:

$$\frac{\partial E}{\partial\lambda_j}=0,\quad 0\le j\le K \tag{25}$$

Evaluating the K+1 equations given in (25) results in a system of K+1 simultaneous linear equations. A solution for a vector of jointly optimal gains, or scale factors, $(\lambda_0, \lambda_1, \ldots, \lambda_K)$ may then be obtained by solving the following equation:

$$\begin{bmatrix} R_{cc}(0,0) & R_{cc}(0,1) & \cdots & R_{cc}(0,K)\\ R_{cc}(1,0) & R_{cc}(1,1) & \cdots & R_{cc}(1,K)\\ \vdots & \vdots & \cdots & \vdots\\ R_{cc}(K,0) & R_{cc}(K,1) & \cdots & R_{cc}(K,K)\end{bmatrix}\begin{bmatrix}\lambda_0\\ \lambda_1\\ \vdots\\ \lambda_K\end{bmatrix}=\begin{bmatrix}R_{pc}(0)\\ R_{pc}(1)\\ \vdots\\ R_{pc}(K)\end{bmatrix} \tag{26}$$

Those who are of ordinary skill in the art realize that a solving of eqn. (26) does not need to be performed by coder 600 in real time. Coder 600 may solve eqn. (26) off line, as part of a procedure to train and obtain gain vectors $(\lambda_0, \lambda_1, \ldots, \lambda_K)$ that are stored in a respective gain information table 626. Each gain information table 626 may comprise one or more tables that store gain information, that is included in, or may be referenced by, a respective error minimization unit/circuitry 608, and may then be used for quantizing and jointly optimizing the excitation vector-related gain terms $(\lambda_0, \lambda_1, \ldots, \lambda_K)$. Note that the gain terms $\beta_i$'s and $\gamma$, required by the combined synthetic excitation ex(n) defined in eqn. (11) (and restated below):

$$ex(n)=\gamma\tilde{c}_I(n)+\sum_{i=-K_1}^{K_2}\beta_ic_i(n),\quad 0\le n<N,\quad -K_1\le i\le K_2,\qquad K=1+K_1+K_2 \tag{27}$$

may be obtained, using the variable mapping specified in eqn. (14), as follows:

$$\beta_i=\lambda_{K_1+i},\ -K_1\le i\le K_2;\ \gamma=\lambda_K \tag{28}$$

Given each gain information table 626 thus obtained, the task of coder 600, and in particular error minimization unit 608, is to select a gain vector, that is, a $(\lambda_0, \lambda_1, \ldots, \lambda_K)$, using the gain information table 626, such that the perceptually weighted error energy for the subframe, E, as represented by eqn. (24), is minimized over the vectors in the gain information table which are evaluated. To assist in selecting a $(\lambda_0, \lambda_1, \ldots, \lambda_K)$ vector that yields a minimum energy for the perceptually weighted error vector, each term involving in the representation of E as expressed in eqn. (24) may be precomputed for each $(\lambda_0, \lambda_1, \ldots, \lambda_K)$ vector and stored in a respective gain information table 626, wherein each gain information 626 comprises a lookup table.

Once a gain vector is determined based on a gain information table 626, each element of the selected $(\lambda_0, \lambda_1, \ldots, \lambda_K)$ may be obtained by multiplying, by the value '−0.5', a corresponding element of the first (K+1) (that is, $$-2\sum_{j=0}^{K}\lambda_j\Bigg)$$

of the precomputed terms (corresponding to the gain vector selected) of equation (24). This makes it possible to store the precomputed error terms (thereby reducing the computation needed to evaluate E), and eliminate the need to explicitly store the actual $(\lambda_0, \lambda_1, \ldots, \lambda_K)$ vectors in a quantization table. Since the correlations $R_{pp}$, $R_{pc}$, and $R_{cc}$ are explicitly decoupled from the gain terms $(\lambda_0, \lambda_i, \ldots, \lambda_K)$ by the decomposition process yielding $\bar{c}'_j(n)$, $0 \leqq j \leqq K$ as described above, the correlations $R_{pp}$, $R_{pc}$, and $R_{cc}$ may be computed only once for each subframe. Furthermore, a computation of $R_{pp}$ may be omitted altogether because, for a given subframe, the correlation $R_{pp}$ is a constant, with the result that with or without the correlation $R_{pp}$ in equation (24) the same gain vector, that is, $(\lambda_0, \lambda_1, \ldots, \lambda_K)$, would be chosen.

When the terms of the equation (24) are precomputed as described above, an evaluation of eqn. (24) may be efficiently implemented with $$\frac{(K+1)[(K+1)+3]}{2}$$

Multiply Accumulate (MAC) operations per gain vector being evaluated. One of ordinary skill in the art realizes that although a particular gain vector quantizer, that is, a particular format of gain information table 626, of error minimization unit 608 are described herein for illustrative purposes, the methodology outlined is applicable to other methods of quantizing the gain information, such as scalar quantization, vector quantization, or a combination of vector quantization and scalar quantization techniques, including memoryless and/or predictive techniques. As is well known in the art, use of scalar quantization or vector quantization techniques would involve storing gain information in the gain information table 626 that may then be used to determine the gain vectors.

Thus, during operation of coder 600 error weighting filter 107 outputs a weighted error signal e(n) to error minimization circuitry 608 which outputs multi-tap filter coefficients and an LTP filter delay (L) selected to minimize a weighted error value. As discussed above, the filter delay comprises a sub-sample resolution value. A multi-tap LTP filter 604 is provided that receives the filter coefficients and the pitch delay, along with a fixed-codebook excitation, and outputs a combined synthetic excitation signal based on the filter delay and the multi-tap filter coefficients.

In both FIG. 6 and FIG. 7 (described below), the multi-tap LTP filter 604, 704 comprises an adaptive codebook receiving the filter delay and outputting an adaptive codebook vector. A vector generator 620, 720 generates time-shifted/combined adaptive codebook vectors. A plurality of scaling units 621, 721 are provided, each receiving a time-shifted adaptive codebook vector and outputting a plurality of scaled time-shifted codebook vectors. Note that the time-shift value for one of the time-shifted adaptive codebook vectors may be 0, corresponding to no time-shift. Finally, summation circuitry 612 receives the scaled time-shifted codebook vectors, along with the selected, scaled FCB excitation vector, and outputs the combined synthetic excitation signal as a sum of the scaled time-shifted codebook vectors and the selected, scaled FCB excitation vector.

Figure 7:
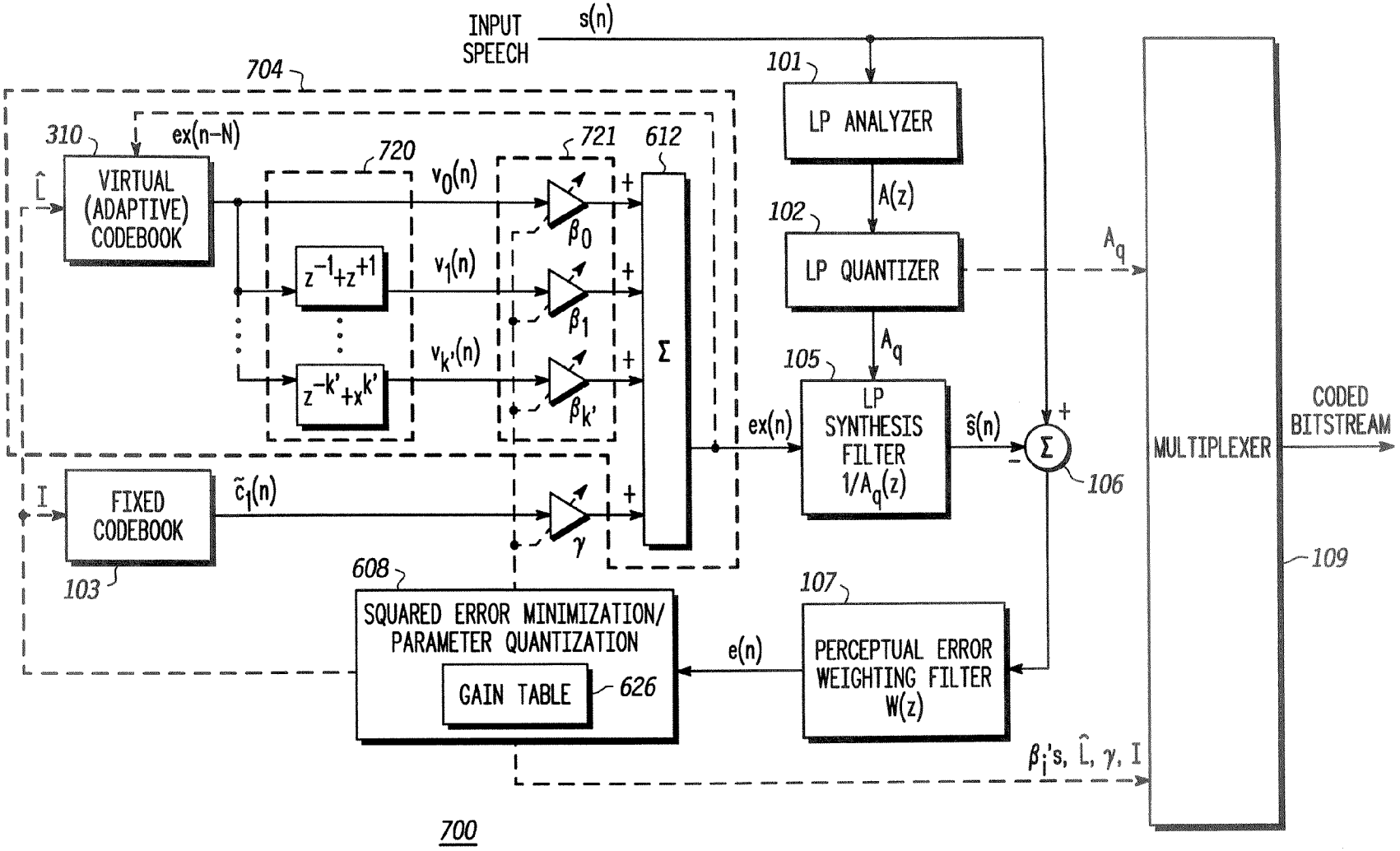
FIG. 7 is a block diagram of a Code Excited Linear Prediction (CELP) coder in accordance with another embodiment of the present invention. (symmetric implementation of the sub-sample resolution multi-tap LTP filter).

Another embodiment of the present invention is now described and is shown in FIG. 7. As previously discussed, the coefficients $\beta_i$ of the multi-tap LTP filter, which is using a sub-sample resolution delay $\hat{L}$, are largely freed from modeling the non-integer values of the LTP filter delay $\hat{L}$, because for values of $\hat{L}$ with a fractional component, modeling of the fractionally delayed samples is done explicitly using an interpolation filter; for example, as taught in Gerson et. al. and Kroon et. al. Still, even when a sub-sample resolution value of delay is used, the resolution with which $\hat{L}$ is represented is typically limited by design choices such as the maximum oversampling factor used by the interpolation filter and the resolution of the quantizer for representing discrete values of $\hat{L}$. The process of computing or selecting the speech coder gains so as to minimize subframe weighted error energy E of eqn. (24), uses the K degrees of freedom inherent in the K $\beta_i$ coefficients to compensate for that discrepancy. In general, this is a positive effect. However, if the bit allocation for quantizing the speech coder gains is limited, it may be advantageous to redefine the sub-sample resolution delay multi-tap LTP filter (or an ACB implementation thereof) so that the modeling ability to compensate for distortion due representing $\hat{L}$ with selected (and finite) resolution, is excised from the multi-tap filter taps $\beta_i$. Such a formulation reduces the variance of the $\beta_i$ coefficients, making $\beta_i$'s more amenable to subsequent quantization. In that case, the modeling elasticity of the $\beta_i$ coefficients is limited to representing the degree of periodicity present and modeling the spectral shaping—both byproducts of seeking to minimize E of eqn. (24).

Forcing a sub-sample resolution multi-tap LTP filter to be odd ordered—that is, requiring filter order K to be an odd number—and the filter to be symmetric—that is, having a property that $\beta_{-i}=\beta_i$, $K_1=K_2$, and $K_1 \leqq i \leqq K_2$—results in an LTP filter 704 meeting the above design objectives. Note that a symmetric filter may be even ordered, but in the preferred embodiment it is chosen to be odd. A version of the LTP filter transfer function of eqn. (6), modified to correspond to an odd, symmetric filter, is shown below:

$$P(z) = \frac{1}{1 - \beta_0 z^{-\hat{L}} - \sum_{i=1}^{K'} \beta_i \left(z^{-\hat{L}-i} + z^{-\hat{L}+i}\right)}, \quad K' \geq 1, \quad K = 1 + 2K' \tag{6a}$$

The filter of the preferred embodiment is now described in the context of an ACB codebook implementation. From eqn. (8), recall the ACB vector definition:

$$ex(n)=ex(n-\hat{L}), 0 \leqq n < N \tag{29}$$

For values of $\hat{L}$ with a fractional component, an interpolating filter is used to compute the delayed samples. Define a new variable K', where $K'=K_1=K_2$. Next, extend ex(n) by K' samples beyond the $N^{th}$ sample of the subframe:

$$ex(n)=ex(n-\hat{L}), N \leqq n < N+K', K' \geqq 1 \tag{30}$$

The order of the symmetric filter is:

$$K=1+2K' \tag{31}$$

In the preferred embodiment, K'=1. Since $\beta_{-i}=\beta_i$, it is convenient to consider only unique $\beta_i$ values; that is $\beta_i$ coefficients indexed by $0 \leqq i \leqq K'$ instead of by $-K' \leqq i \leqq K'$. This may be done as follows. Using the samples ex(n) generated in eqn. (30-31), a new signal, $v_i(n)$, is now defined:

$$v_i(n) = \begin{cases} ex(n), & i = 0 \\ [ex(n-i) + ex(n+i)], & 1 \leq i \leq K' \end{cases}, \quad \text{for } 0 \leq n < N \tag{32}$$

The combined synthetic subframe excitation ex(n) may then be expressed, using the results from eqn. (30-32), as:

$$ex(n) = \gamma \tilde{c}_I(n) + \sum_{i=0}^{K'} \beta_i v_i(n), \quad 0 \leq n < N \tag{33}$$

The task of the speech encoder is to select the LTP filter parameters—$\hat{L}$ and $\beta_i$ coefficients—as well as the excitation codebook index I and codevector gain $\gamma$, so that the subframe weighted error energy between the speech s(n) and the coded speech $\hat{s}(n)$ is minimized.

Rewriting equation (33) results in:

$$ex(n) = \sum_{j=0}^{K'+1} \lambda_j \bar{c}_j(n), \quad 0 \leq n < N, \quad \text{where} \tag{34}$$

$$\bar{c}_j(n) = \begin{cases} v_j(n) & 0 \leq j \leq K' \\ \tilde{c}_I(n) & j = K'+1 \end{cases}, \quad 0 \leq n < N \tag{35}$$

$$\lambda_j = \begin{cases} \beta_j, & 0 \leq j \leq K' \\ \gamma, & j = K'+1 \end{cases} \tag{36}$$

Let ex(n), filtered by the perceptually weighted synthesis filter, be:

$$ex'(n) = \sum_{j=0}^{K'+1} \lambda_j \bar{c}'_j(n), \quad 0 \leq n < N \tag{37}$$

$\bar{c}'_j(n)$ is a version of $\bar{c}_j(n)$ filtered by the perceptually weighted synthesis filter $H(z)=W(z)/A_q(z)$. As before, let p(n) be the input speech s(n) filtered by the perceptual weighting filter W(z). Then e(n) the perceptually weighted error per sample, is:

$$e(n) = p(n) - ex'(n) = p(n) - \sum_{j=0}^{K'+1} \lambda_j \bar{c}'_j(n), \quad 0 \le n < N. \tag{38}$$

E, the subframe weighted error energy, is given by:

$$\begin{aligned} E &= \sum_{n=0}^{N-1} e^2(n) \\ &= \sum_{n=0}^{N-1} [p(n) - ex'(n)]^2 \\ &= \sum_{n=0}^{N-1} \left[ p(n) - \sum_{j=0}^{K'+1} \lambda_j \bar{c}'_j(n) \right]^2 \end{aligned} \tag{39}$$

which is similar to eqn. (17). Following on with the same analysis and derivation as eqns. (18-26), we get the following error expression $$E = R_{pp} - 2\sum_{j=0}^{K'+1} \lambda_j R_{pc}(j) + 2\sum_{i=0}^{K'} \sum_{j=i+1}^{K'+1} \lambda_i \lambda_j R_{cc}(i, j) + \sum_{j=0}^{K'+1} \lambda_j^2 R_{cc}(j, j) \tag{46}$$

which leads to the following set of simultaneous equations:

$$\begin{bmatrix} R_{cc}(0,0) & R_{cc}(0,1) & \dots & R_{cc}(0, K'+1) \\ R_{cc}(1,0) & R_{cc}(1,1) & \dots & R_{cc}(1, K'+1) \\ \vdots & \vdots & \dots & \vdots \\ R_{cc}(K'+1, 0) & R_{cc}(K'+1, 1) & \dots & R_{cc}(K'+1, K'+1) \end{bmatrix} \begin{bmatrix} \lambda_0 \\ \lambda_1 \\ \vdots \\ \lambda_{K'+1} \end{bmatrix} = \begin{bmatrix} R_{pc}(0) \\ R_{pc}(1) \\ \vdots \\ R_{pc}(K'+1) \end{bmatrix} \tag{48}$$

As before, those who are of ordinary skill in the art realize that a solving of equation (48) does not need to be performed by coder 700 in real time. Coder 700 may solve equation (48) off line, as part of a procedure to train and obtain gain vectors ($\lambda_0$, $\lambda_1$, . . . , $\lambda_{K'+1}$) that are stored in a respective gain information table 726. Gain information table 726 may comprise one or more tables that store gain information, that is included in, or may be referenced by, a respective error minimization unit 708, and may then be used for quantizing and jointly optimizing the excitation vector-related gain terms ($\lambda_0$, $\lambda_1$, . . . , $\lambda_{K'+1}$).

In the description of the preferred embodiments of the invention thus far, the spacing of the multi-tap LTP filter taps was given as being 1 sample apart. In another embodiment of the current invention, the spacing between the multi-tap filter taps may be different than one sample. That is, it may be a fraction of a sample or it may be a value with an integer and fractional part. This embodiment of the invention is illustrated by modifying eqn. (6) as follows:

$$P(z) = \frac{1}{1 - \sum_{i=K_1}^{K_2} \beta_i z^{-\hat{L}+i\Delta}}, \tag{6b}$$

$$K_1 \ge 0, \quad K_2 \ge 0, \quad K_1 + K_2 > 0, \quad K = 1 + K_1 + K_2, \quad \Delta \ne 1$$

Note that eqn. (6a) may be similarly modified, resulting in:

$$P(z) = \frac{1}{1 - \beta_0 z^{-\hat{L}} - \sum_{i=1}^{K'} \beta_i \left( z^{-\hat{L}-i\Delta} + z^{-\hat{L}+i\Delta} \right)}, \tag{6c}$$

$$K' \ge 1, \quad K = 1 + 2K', \quad \Delta \ne 1$$

The Δ value may be tied to the resolution of the interpolating filter used. If the maximum resolution of the interpolating filter is $$\frac{1}{8}$$

sample relative to frequency at which signal s(n) is sampled, Δ may be chosen to be $$\frac{l}{8},$$

where $l \geqq 1$. Note also that although the spacing of the filter taps is shown in eqn. (6b) and (6c) as uniform, non-uniform spacing of the taps may also be implemented. Further note, that for values of Δ<1, the filter order K may need to be increased, relative to the case of single sample spacing of the taps.

To reduce the amount of computational complexity associated with the selection of excitation parameters—$\hat{L}$, $\beta_i$'s, I, and γ—in coder 700, the LTP filter parameters—$\hat{L}$ and $\beta_i$'s—may be selected first, assuming zero contribution from the fixed codebook. This results in a modified version of the subframe weighted error of eqn (46), with the modification consisting of elimination, from E, of the terms associated with the fixed codebook vector, yielding a simplified weighted error expression:

$$E = R_{pp} - 2\sum_{j=0}^{K'} \lambda_j R_{pc}(j) + 2\sum_{i=0}^{K'-1} \sum_{j=i+1}^{K'} \lambda_i \lambda_j R_{cc}(i, j) + \sum_{j=0}^{K'} \lambda_j^2 R_{cc}(j, j) \tag{51}$$

Computing a set of ($\lambda_0$, $\lambda_1$, . . . , $\lambda_K$) gains which result in minimization of E in eqn. (51), involves solving the K'+1 simultaneous linear equations below:

$$\begin{bmatrix} R_{cc}(0,0) & R_{cc}(0,1) & \dots & R_{cc}(0, K') \\ R_{cc}(1,0) & R_{cc}(1,1) & \dots & R_{cc}(1, K') \\ \vdots & \vdots & \dots & \vdots \\ R_{cc}(K', 0) & R_{cc}(K', 1) & \dots & R_{cc}(K', K') \end{bmatrix} \begin{bmatrix} \lambda_0 \\ \lambda_1 \\ \vdots \\ \lambda_{K'} \end{bmatrix} = \begin{bmatrix} R_{pc}(0) \\ R_{pc}(1) \\ \vdots \\ R_{pc}(K') \end{bmatrix} \tag{52}$$

Alternately, a quantization table or tables may be searched for a ($\lambda_0$, $\lambda_1$, . . . , $\lambda_{K'}$) vector which minimizes E in eqn. 51, according to a search method used. In that case, the LTP filter coefficients are quantized without taking into account FCB vector contribution. In the preferred embodiment, however, the selection of quantized values of is guided by evaluation of eqn. (46), which corresponds to joint optimization of all (K'+2) coder gains. In either of the two cases, the weighted target signal p(n) may be modified to give the weighted target signal $p_{fcb}(n)$ for the fixed codebook search, by removing from p(n) the perceptually weighted LTP filter contribution, using the $(\lambda_0, \lambda_1, \ldots, \lambda_{K'})$ gains, which were computed (or selected from quantization table(s)) assuming zero contribution from the FCB:

$$p_{fcb}(n) = p(n) - \sum_{j=0}^{K'} \lambda_j \bar{c}'_j(n), \quad 0 \le n < N \tag{53}$$

The FCB is then searched for index i, which minimizes the subframe weighted error energy $E_{fcb,i}$, subject to the method employed for search:

$$E_{fcb,i} = \sum_{n=0}^{N-1} (p_{fcb}(n) - \gamma_i \tilde{c}'_{i'}(n))^2 \tag{54}$$

In the above expression, i is the index of the FCB vector being evaluated, $\tilde{c}'_i(n)$ is the i-th FCB codevector filtered by the zero-state weighted synthesis filter, and $\gamma_i$ is the optimal scale factor corresponding to $\tilde{c}'_i(n)$. The winning index i becomes I, the codeword corresponding to the selected FCB vector.

Alternately, the FCB search can be implemented assuming that the intermediate LTP filter vector is 'floating.' This technique is described in the Patent WO9101545A1 by Ira A. Gerson, titled "Digital Speech Coder with Vector Excitation Source Having Improved Speech Quality," which discloses a method for searching an FCB codebook, so that for each candidate FCB vector being evaluated, a jointly optimal set of gains is assumed for that vector and the intermediate LTP filter vector. The LTP vector is "intermediate" in the sense that its parameters have been selected assuming no FCB contribution, and are subject to revision. For example, upon completion of the FCB search for index I—all the gains may be subsequently reoptimized, either by being recalculated (for example, by solving eqn. (48)) or by being selected from quantization table(s) (for example, using eqn. (46) as a selection criterion). Define the intermediate LTP filter vector, filtered by the weighted synthesis filter, to be:

$$\bar{c}'_{ltp}(n) = \sum_{j=0}^{K'} \lambda_j \bar{c}'_j(n) \tag{55}$$

The weighted error expression, corresponding to the FCB search assuming jointly optimal gains, is then given by:

$$E_{fcb,i} = \sum_{n=0}^{N-1} (p_{fcb}(n) - \chi_i \bar{c}'_{ltp}(n) - \gamma_i \tilde{c}'_i(n))^2 \tag{56}$$

For each $\tilde{c}'_i(n)$ being evaluated, jointly optimal parameters $\chi_i$ and $\gamma_i$ are assumed. Index i, for which eqn (56) is minimized (subject to FCB search method employed) becomes the selected FCB codeword I. Alternately, a modified form of eqn. (56) may be used, whereby for each FCB vector being evaluated, all (K'+2) scale factors are jointly optimized, as shown below:

$$E_{fcb,i} = \sum_{n=0}^{N-1} \left( p_{fcb}(n) - \sum_{j=0}^{K'} \lambda_{j,i} \bar{c}'_j(n) - \gamma_i \tilde{c}'_i(n) \right)^2 \tag{57}$$

That is, for the i-th FCB vector being evaluated, a set of jointly optimal gain parameters $(\lambda_{0,i}, \ldots, \lambda_{L',i}, \gamma_i)$ is assumed.

For either of the two methods of FCB search, i.e., (i) redefining the target vector for the FCB search by removing from it the contribution of the intermediate LTP vector, or (ii) implementing the FCB search assuming jointly optimal gains, it may be advantageous, from quantization efficiency vantage point, to constrain the gains for the intermediate LTP vector. For example, if it is known that the quantized values of the $\beta_i$ coefficients will be limited by design not to exceed a predetermined magnitude, the intermediate LTP filter coefficients may be likewise constrained when computed.

One of the embodiments places the following constraints on the LTP filter coefficients to obtain intermediate filtered LTP vector $\bar{c}'_{ltp}(n)$. First, we assume that the LTP filter coefficients are symmetric, i.e., $\beta_{-i}=\beta_i$, and that the LTP filter coefficients are zero for i>1. Furthermore we also assume that the intermediate filtered LTP vector is of the form:

$$\bar{c}'_{ltp}(n) = \theta\left(\alpha \bar{c}'_0(n) + \frac{1-\alpha}{2} \bar{c}'_1(n)\right) \quad 0.5 \le \alpha \le 1.0 \tag{58}$$

The above constraint ensures that the shaping filter characteristics are low pass in nature. Note that the λ's in Eq. 55 now are: $\beta_0=\theta\alpha$, $$\beta_1 = \theta \frac{1-\alpha}{2}.$$

Now choose an overall LTP gain value (θ) and a low-pass shaping coefficient (α) to minimize the weighted error energy value $$E = \sum_n (p(n) - \bar{c}'_{ltp}(n))^2 \tag{59}$$

Setting partial differentiation of Eq. 59 with respect to θ to zero results in $$\theta = \frac{\alpha R_{pc}(0) + \frac{1-\alpha}{2} R_{pc}(1)}{\alpha^2 R_{cc}(0,0) + \alpha(1-\alpha) R_{cc}(1,0) + \left(\frac{1-\alpha}{2}\right)^2 R_{cc}(1,1)} \tag{60}$$

Substituting the value of θ in eqn. (59), it can be seen that the maximizing the following expression results in minimum value of E.

$$\frac{\left(\alpha R_{pc}(0) + \frac{1-\alpha}{2} R_{pc}(1)\right)^2}{\alpha^2 R_{cc}(0,0) + \alpha(1-\alpha) R_{cc}(1,0) + \left(\frac{1-\alpha}{2}\right)^2 R_{cc}(1,1)} \tag{61}$$

Define:

$$\alpha_1 = R_{cc}(0, 0) + \frac{R_{cc}(1, 1)}{4} - R_{cc}(1, 0)$$

$$\alpha_2 = R_{cc}(1, 0) - \frac{R_{cc}(1, 1)}{2}$$

$$\alpha_3 = \frac{R_{cc}(1, 1)}{4}$$

$$\alpha_4 = R_{pc}(0) - \frac{R_{pc}(1)}{2}$$

$$\alpha_5 = \frac{R_{pc}(1)}{2}$$

Now expression in eqn. (61) becomes $$\frac{(\alpha_4\alpha + \alpha_5)^2}{\alpha_1\alpha^2 + \alpha_2\alpha + \alpha_3} \tag{62}$$

Again differentiating eqn. (62) with respect to $\alpha$ and equating it to zero results in $$\alpha = \frac{\alpha_2\alpha_5 - 2\alpha_4\alpha_3}{\alpha_2\alpha_4 - 2\alpha_1\alpha_5}, \tag{63}$$

which maximizes the expression in eqn. (62). The parameter $\alpha$ thus obtained is further bounded between 1.0 and 0.5 to guarantee a low-pass spectral shaping characteristic. The overall LTP gain value $\theta$ may be obtained via equation 60 and applied directly for use in FCB search method (i) above, or may be jointly optimized (i.e., allowed to "float") in accordance with FCB search method (ii) above. Furthermore, placing different constraints on a would allow other shaping characteristics, such as high-pass or notch, and are obvious to those skilled in the art. Similar constraints on higher order multi-tap filters are also obvious to those skilled in the art, which may then include band-pass shaping characteristics.

Figure 8:
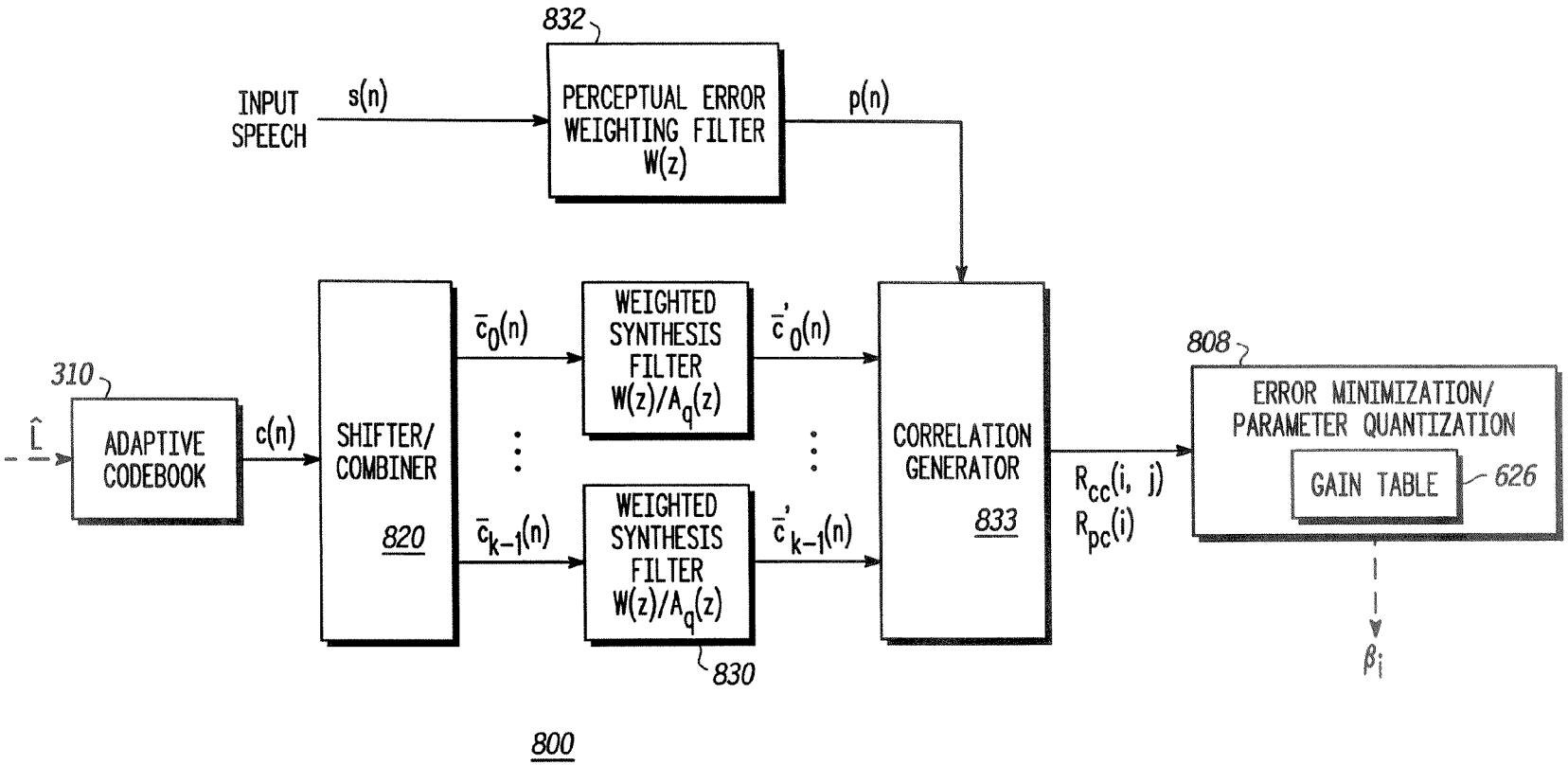
FIG. 8 is a block diagram of the signal flows and processing blocks for the present invention for use in a coder (sub-sample resolution multi-tap LTP filter and a symmetric implementation of the sub-sample resolution multi-tap LTP filter).
Figure 9:
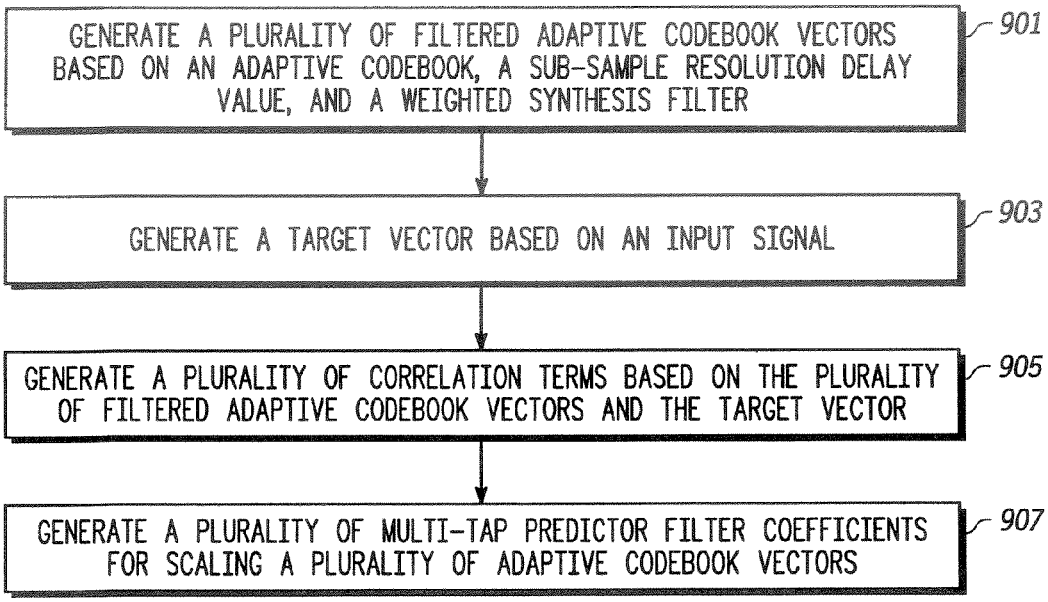
FIG. 9 is a logic flow diagram of steps executed by the CELP coder of FIG. 8 in coding a signal in accordance with an embodiment of the present invention.

While many embodiments have been discussed thus far, FIG. 8 depicts a generalized apparatus that comprises the best mode of the present invention, while FIG. 9 is a flow chart showing the corresponding operations. As can be seen in FIG. 8, a sub-sample resolution delay value $\hat{L}$ is used as an input to Adaptive Codebook (310) and Shifter/Combiner (820) to produce a plurality of shifted/combined adaptive codebook vectors as described by eqns. (8-10, 13), and again by eqns. (29-32, 35). As described previously, the present invention may comprise an Adaptive Codebook or a Long-term predictor filter, and may or may not comprise an FCB component. Additionally, a weighted synthesis filter $W(z)/A_q(z)$ (830) is employed, which results from the algebraic manipulation of the weighted error vector e(n), as described in the text leading to eqn. (16). As one who is skilled in the art may appreciate, weighted synthesis filter (830) may be applied to vectors $\bar{c}_i(n)$ or equivalently to c(n), or may be incorporated as part of Adaptive Codebook (310). The filtered adaptive codebook vectors $\hat{c}'_j(n)$ (901) and target vector p(n) (903), which may be based on a perceptually weighted version of the input signal s(n) (filtered through perceptual error weighting filter (832)), are then presented to the Correlation Generator (833), which outputs the plurality of correlation terms (905) defined in eqns. (20-23) that are necessary for input to error minimization unit (808). Based on the plurality of correlation terms, the perceptually weighted error value E is evaluated without the need for explicit filtering operations, to produce a plurality of multi-tap filter coefficients $\beta_i$ (907). Depending on the embodiment, the error value E may be evaluated in eqns. (24, 46, 51) by utilizing values in a Gain Table 626 as described for coder (600, 700), or may be solved directly through a set of simultaneous linear equations as given in eqns. (26, 48, 52, 63). In either case, the multi-tap filter coefficients $\beta_i$ are cross-referenced to general form coefficients $\lambda_i$ (eqns. (14, 28)) for notational convenience, i.e., to incorporate the contribution of the fixed codebook without loss of generality.

While the invention has been particularly shown and described with reference to a particular embodiment, it will be understood by those skilled in the art that various changes in form and details may be made therein without departing from the spirit and scope of the invention. For example, the present invention has been described for use with weighting filter W(z). But while specific characteristics of weighting filter W(z) have been stated in terms of a "response based on human auditory perception", for the present invention it is assumed that W(z) may be arbitrary. In extreme cases, W(z) may have a unity gain transfer function W(z)=1, or W(z) may be the inverse of the LP synthesis filter $W(z)=A_q(z)$, resulting in the evaluation of the error in the residual domain. Thus, as one who is skilled in the art would appreciate, the choice of W(z) is of no consequence to the present invention.

Furthermore, the present invention has been described in terms of a generalized CELP framework wherein the architecture presented has been simplified to allow as concise a description of the present invention as possible. However, there may be many other variations on architectures that employ the current invention that are optimized, for example, to reduce processing complexity, and/or to improve performance using techniques that are outside the scope of the present invention. One such technique may be to use principles of superposition to alter the block diagrams such that the weighting filter W(z) is decomposed into zero-state and zero-input response components and combined with other filtering operations in order to reduce the complexity of the weighted error computations. Another such complexity reduction technique may involve performing an open-loop pitch search to obtain an intermediate value of $\hat{L}$ such that the error minimization unit 508, 608, 708 need not test all possible values of $\hat{L}$ during the final (closed-loop) optimization stages.

Note that there exist a number of FCB types, and also a variety of efficient FCB search techniques, known to those skilled in the art. As the particular type of FCB being used is not germane to the current invention, it is simply assumed that the FCB codebook search yields FCB index I, which resulted in minimization of $E_{fcb,i}$, subject to the search strategy that was employed. Additionally, although the present invention has been described in the context of the multi-tap LTP filter being implemented as an Adaptive Codebook, the invention may be equivalently implemented for the case where the multi-tap LTP filter is implemented directly. It is intended that such changes come within the scope of the following claims.

The invention claimed is:

1. A method for coding speech by a speech coder, the method comprising the steps of:

receiving, by the speech encoder, an input signal;

generating, by the speech encoder, a target vector based on the input signal;

generating, by the speech encoder, a plurality of weighted adaptive codebook vectors based on a single sub-sample resolution delay value, an adaptive codebook, and a weighted synthesis filter;

generating, by the speech encoder, a weighted fixed codebook (FCB) excitation vector based on the target vector and the plurality of weighted adaptive codebook vectors;

generating, by the speech encoder, a plurality of correlation terms based on the target vector, the plurality of weighted adaptive codebook vectors, and the weighted FCB excitation vector; and selecting, by the speech encoder, a gain vector from a table in response to an error minimization criterion, wherein the gain vector is comprised of at least two adaptive codebook gains and one fixed codebook gain, and where the error minimization criterion is based on the plurality of correlation terms.

2. The method in claim 1, wherein the adaptive codebook gains form a symmetric long-term filter.

3. The method of claim 1, wherein each generated weighted adaptive codebook vector of the plurality of generated weighted adaptive codebook vectors is associated with a different delay value and wherein a spacing between a delay value associated with a generated weighted adaptive codebook vector of the plurality of generated weighted adaptive codebook vectors and a delay value associated with another generated weighted adaptive codebook vector of the plurality of generated weighted adaptive codebook vectors has a non-integer sample resolution.

4. A method for coding speech by a speech coder, the method comprising generating, by the speech encoder, a plurality of adaptive codebook vectors based on a single sub-sample resolution delay value and an adaptive codebook, wherein each generated adaptive codebook vector of the plurality of adaptive codebook vectors is associated with a delay value and wherein the spacing between at least two adjacent delay values, each corresponding to its respective generated adaptive codebook vector, is different than one sample and is predetermined.

5. The method in claim 4 wherein the spacing between at least two adjacent delay values, each corresponding to its respective adaptive codebook vector, is one of a fraction of a sample and a value with an integer and fractional part.

6. The method of claim 4, further comprising:

generating, by the speech encoder, a plurality of weighted adaptive codebook vectors ($\bar{c}'_0(n) \ldots \bar{c}'_{K-1}(n)$) based on plurality of adaptive codebook vectors and on delay values that are defined with sub-sample resolution;

receiving, by the speech encoder, an input signal s(n);

generating, by the speech encoder, a target vector p(n) based on the input signal;

generating, by the speech encoder, a plurality of correlation terms ($R_{cc}(i,j)$,$R_{pc}(i)$) based on the target vector p(n) and the plurality of weighted adaptive codebook vectors; and generating, by the speech encoder, a plurality of multi-tap long-term predictor filter coefficients ($\beta_i$'s) based on the plurality of correlation terms ($R_{cc}(i,j)$,$R_{pc}(i)$).

7. A speech coder comprising a processor that is configured to receive an input signal, generate a target vector based on the input signal, generate a plurality of weighted adaptive codebook vectors based on a single sub-sample resolution delay value, an adaptive codebook, and a weighted synthesis filter, generate a weighted fixed codebook (FCB) excitation vector based on the target vector and the plurality of weighted adaptive codebook vectors, generate a plurality of correlation terms based on the target vector, the plurality of weighted adaptive codebook vectors, and the weighted FCB excitation vector; and select a gain vector from a table in response to an error minimization criterion, wherein the gain vector is comprised of at least two adaptive codebook gains and one fixed codebook gain, and where the error minimization criterion is based on the plurality of correlation terms.

8. A speech coder comprising a processor that is configured to generate a plurality of adaptive codebook vectors based on a single sub-sample resolution delay value and an adaptive codebook, wherein each generated adaptive codebook vector of the plurality of adaptive codebook vectors is associated with a delay value and wherein the spacing between at least two adjacent delay values, each corresponding to its respective generated adaptive codebook vector, is different than one sample and is predetermined.

* * * * *